United States Patent [19]

Selak

[11] 3,934,868

[45] Jan. 27, 1976

[54] TOP LOADING, CONTINUOUS SUCTION FEEDER ATTACHMENT FOR PRINTING APPARATUS

[75] Inventor: Martin Selak, Des Plaines, Ill.

[73] Assignee: Astro Engineering Corporation, Skokie, Ill.

[22] Filed: Dec. 7, 1973

[21] Appl. No.: 422,877

[52] U.S. Cl. ..... 271/9; 271/13; 271/100; 271/108; 271/238

[51] Int. Cl.[2]... B65H 1/28; B65H 3/08; B65H 9/06; B65H 9/10

[58] Field of Search ..... 271/13, 12, 11, 9, 15, 271/100, 106, 108, 238, 240

[56] References Cited

UNITED STATES PATENTS

| | | | |
|---|---|---|---|
| 551,747 | 12/1895 | Dummer | 271/238 |
| 1,136,562 | 4/1915 | Stokes et al. | 271/13 X |
| 3,032,338 | 5/1962 | Anderson et al. | 271/9 UX |
| 3,093,371 | 6/1963 | Glaser et al. | 271/100 |
| 3,155,386 | 11/1964 | Burleigh | 271/100 X |
| 3,394,930 | 7/1968 | Guggisberg | 271/11 |
| 3,788,637 | 1/1974 | Lattke | 271/13 |

*Primary Examiner*—Evon C. Blunk
*Assistant Examiner*—Bruce H. Stoner, Jr.
*Attorney, Agent, or Firm*—Leonard H. King

[57] ABSTRACT

Pneumatic means are synchronously coupled to an offset machine or the like in order to positively separate and pull down the bottom sheet in a stack. Movement of the pneumatic means is synchronized with the movement of a pivotal roller that advances the pulled-down sheet onto a conveyor belt for delivery of the sheet to the utilization device. The sheet being fed is automatically aligned in a lateral direction by movable guide means that are synchronized with the feeding of the sheet. The forward edges of the lower most sheets on the stack are separated by a flow of air.

11 Claims, 6 Drawing Figures

TOP LOADING, CONTINUOUS SUCTION FEEDER ATTACHMENT FOR PRINTING APPARATUS

BACKGROUND OF THE INVENTION

This invention relates generally to single sheet feeding apparatus and more particularly an attachment for vacuum feeding single sheets into the printing apparatus.

DESCRIPTION OF THE PRIOR ART

Bottom feeding from a vertical stack of sheets, by means of a movable suction device, is well known in the art. U.S. Pat. Nos. 3,093,371; 3,155,386; 3,394,930; and 3,458,042 all relate to this art. In each of the aforementioned issued U.S. patents a suction cup that is attached to a suitable vacuum source is moved into position below the lower most sheet in a vertical stack for the purpose of pulling downwardly the lower most sheet and depositing it on transfer means for delivery to a utilization device such as a printing press. None of the foregoing issued U.S. patents relate to an attachment for a printing device wherein the drive system of the printing device is used for synchronously actuating the linkages and the suction device of the attachment and for transferring one sheet at a time to the printing apparatus.

SUMMARY OF THE INVENTION

By way of contrast to the aforementioned prior art, the present invention provides an attachment for a printing device such as a multilith offset machine. Since the present invention is in the form of an attachment, it does not interfere with the normal functioning of the utilization device. Instead it is coupled thereto and driven by the utilization device and, when not in use, may be left in place without interferring with the normal printing functions.

The present invention is a top-loading, continuous suction feeder that is capable of handling a wide variety of stock such as cartons, booklets, folded stock, catalogs, brochures etc. The present invention is readily adaptable to both short and long runs and is adjustable so as to accommodate special stock material. The loading section of the present invention may be adjusted to handle a wide variety of applications and may be changed from one to the other in a very short time without any special skill. Since the present invention does not interfere with the normal operation of the utilization device, the type of printing that is done may be readily changed. That is, it is a simple matter to switch from booklet imprinting to sheet fed printing and then back again in as short a time as possible.

As will be explained more fully hereinafter, there is no down time for loading since this may be done from the top while the press is running thereby saving time and increasing production. By feeding from the bottom, the set-up time normally required when printing envelopes and other folded pieces for example has been eliminated. A two-up feed or loading station virtually doubles the capacity of the present invention which is sufficiently precise and accurate enough for two color work.

The attachment comprising the present invention includes a transmission system that is adapted to be coupled directly to a suitable portion of the drive system in the printing machine. The transmission system of this invention, through suitable linkages, synchronously moves a plurality of suction members into engagement with the lower most sheet in a stack of vertically aligned sheets. The same transmission system concurrently moves the suction means together with the lower most sheet in a downward direction and deposits it on the first of plurality of rollers and at the same time moves a companion roller onto the top of the pull down sheet. The first mentioned roller is also driven by the same transmission system and, through a plurality of belts driven by the same transmission system, delivers the sheets one at a time to the printing device. When the lower most sheet is deposited on the belts for delivery to the printing device, alignment means that are also coupled to the transmission system, displace the sheet laterally into the proper position.

An air valve that is responsive to a cam driven by the transmission system selectively applies negative pressure to the suction means at appropriate times. Positive pressure is delivered to the forward edge of the lower most sheets in order to assure separation thereof so that the bottom sheet may be easily pulled down by the suction means and may be properly placed on the first roller of the conveyor system. As will be explained more fully hereinafter, a single transmission system that is driven by the printing apparatus provides all of the foregoing functions.

Accordingly, it is an object of the present invention to provide an improved sheet feeding attachment for a printing device.

It is another object of the present invention to provide an improved bottom sheet feeding attachment for a printing device, as described above, having a transmission system coupled to drive of the printing device.

Still another object of the present invention is to provide an improved bottom sheet feeding attachment for a printing device as described above, wherein a single transmission actuates timed sheet feeding and aligning means.

These and other objects, features and advantages of the invention will, in part, be pointed out with particularity, and will, in part, become obvious from the following more detailed description of the present invention, taken into conjunction with the accompanying drawing, which forms an integral part thereof.

BRIEF DESCRIPTION OF THE DRAWING

In the various figures of the drawing like reference characters designate like parts. In the drawing.

DESCRIPTION OF THE PREFERRED EMBODIMENT

Figure 1:
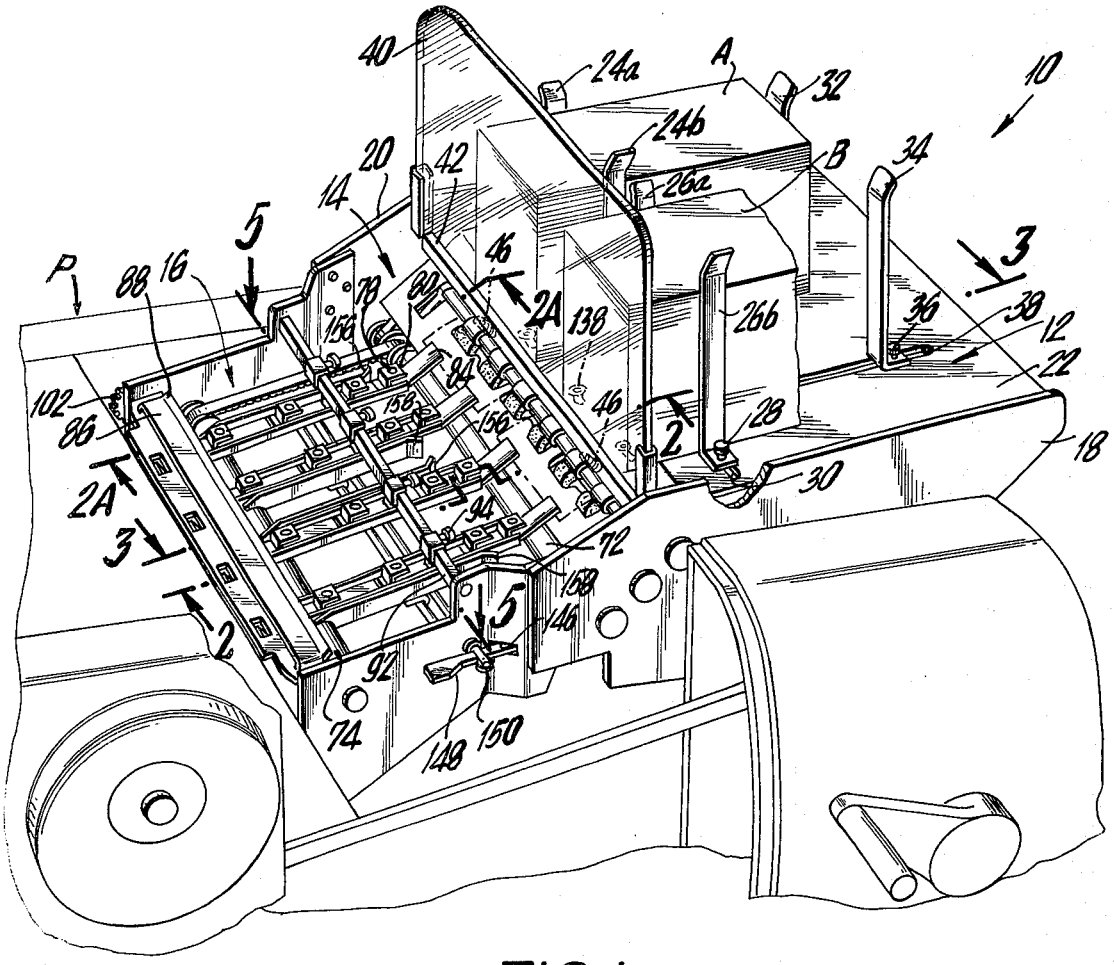
FIG. 1 is a perspective view of the present invention shown in relation to a fragmentarily illustrated printing device.

Referring first to FIG. 1. There is shown the attachment 10 comprising the present invention in its working position relative to a printing device P. The feeder attachment 10 comprises a loading section 12, a transfer section 14 and a conveyor section 16. A pair of parallel, spaced apart side walls 18 and 20 define the lateral extremities of the feeder attachment 10.

A base wall 22, in combination with the side walls 18 and 20 define the loading section 12. Two pair of upright side guide members 24*a*, 24*b* and 26*a*, 26*b* are adjustably mounted on the base plate 22 by means of screws 28 that are received in transverse slots 30, only one of which is shown. A pair of upright rear guide members 32 and 34 are also adjustably mounted on the base wall 22 by means of screws 36 and slots 38, only one of which is shown. The slots 38 are oriented perpendicular to the slots 30. A first stack of sheets A may be loaded within the confines of the upright guides 24*a*, 24*b* and 32 while a second stack of sheets B may be loaded within the confines of the upright guide members 26*a*, 26*b* and 34. It will be evident that the foregoing construction permits a wide range of stock sizes to be accommodated in the loading section 12. In addition, by virtue of the foregoing construction, either one or both stacks of sheets may be loaded as required.

At the forward end of the loading section 22 there is provided a barrier 40 against which the stacks of paper A and B abut. A lower transverse edge 42 of the barrier 40 is hollow and is provided with a plurality of nozzles 44 that are directed towards the forward edge of the lower most sheets in the stacks A and B. Tubes 46 are coupled to a suitable source of compressed air (not shown) and are in communication with the nozzle 44 so that a flow of air may be directed against the forward edges of the lower most sheet in the stacks A and B in order to provide separation means therefor.

The transfer section 14 of the attachment 10 is comprised of a downwardly bent wall 48 that is contiguous with the base wall 22 of the loading section 12. A plurality of openings 50 are formed in the wall 48 in order to receive therethrough the peripheral surface portion of a plurality of driven rollers 52 which are laterally spaced apart and which are mounted on a transverse shaft 54 that is journalled in the side walls 18 and 20. In a manner to be described more fully hereinafter, the rollers 52 provide friction means for moving the sheets through the transfer section 14.

The conveyor section 16 of the feeder 10 is comprised of three transversely oriented shafts 56, 58 and 60. A toothed pulley 62 is mounted on the shaft 56 and two toothed pulleys 64 are mounted on the shaft 58. A toothed pulley 66 is also mounted on the shaft 60. A first timing belt 68 is trained about the pulley 62 and one of the pulleys 64 while a second timing belt 70 is trained about the other pulley 64 and the pulley 66. In the embodiment illustrated, the shafts 58 and 60 are each provided with four laterally spaced apart rollers 72 and 74, respectively, and a belt 76 is trained about respective pairs of rollers 72 and 74.

Directly above the upper run of each of the belts 76 there is provided, in spaced relation thereto, a plurality of ball bearings 78 that are retained in upper and lower races 80 and 82. The end 84 of each of the lower races 82 which is positioned in the vicinity of the roller 72, is bent upwardly in order to define, in combination with the base plate 48 of the transfer section 14, an inlet to the conveyor section 16. Immediately downstream of the last transverse row of ball bearings 78 there is provided a transverse bracket 86 having an upwardly bent end 88 that defines an outlet for the conveyor section 16. The ball bearing 78 and the races 80 and 82 are supported for vertical adjustment by means of a bracket 90 that is clamped to a transverse bar 92 by means of screws 94. The bar 92 extends between and is secured to the side walls 18 and 20. Downstream of the rollers 74 there is provided a transverse filler plate 96 that is also secured to the side walls 18 and 20. The downstream end of the filler plate 96 is closely adjacent to the input to the printing device P. In addition, and for purposes to be described hereinafter, the transfer plate 96 is also provided with a plurality of openings 98.

The transmission system 100 of the attachment 10 comprises a gear 102 that is journalled on a shaft 104 which is mounted in the side wall 20 proximate the downstream end of the conveyor section 16. The gear 102 is in meshing engagement with one of the drive gears (not shown) of the printing device P and is also in meshing engagement with a gear 106 that is secured to the shaft 60. A gear 108 is secured to the shaft 56 and is in meshing engagement with a gear 110 mounted on a shaft 112 that is also secured in the side wall 16. The gear 110 meshes with a gear 114 which is secured to a shaft 116 that is also mounted in the side wall 16. Thus, the gear 116 is also driven by the gear 102 through the timing belts 68 and 70.

A crank arm 120 is pivotally coupled at one slotted end thereof to the gear 114 by means of a pin 122. The other adjustable end of the crank arm 120 is pivotally coupled to one end of each of a plurality of laterally spaced apart levers 124 by means of a transverse pin 126. The other end of the levers 124 extend through the openings 50 in the plate 48 and are each provided with a roller 128 that is in opposition to the friction rollers 52. An arm 130 that extends from each of the levers 124 pivotally supports, by means of a pin 132, a bell crank comprised of first and second arms 134 and 136, respectively. A suction cup 138 is secured to each of the arms 134 and each of the arms 136 is positioned adjacent an adjustable stop 140. A spring 142 biases the bell crank arms 134 and 136.

Figures 3, 5:
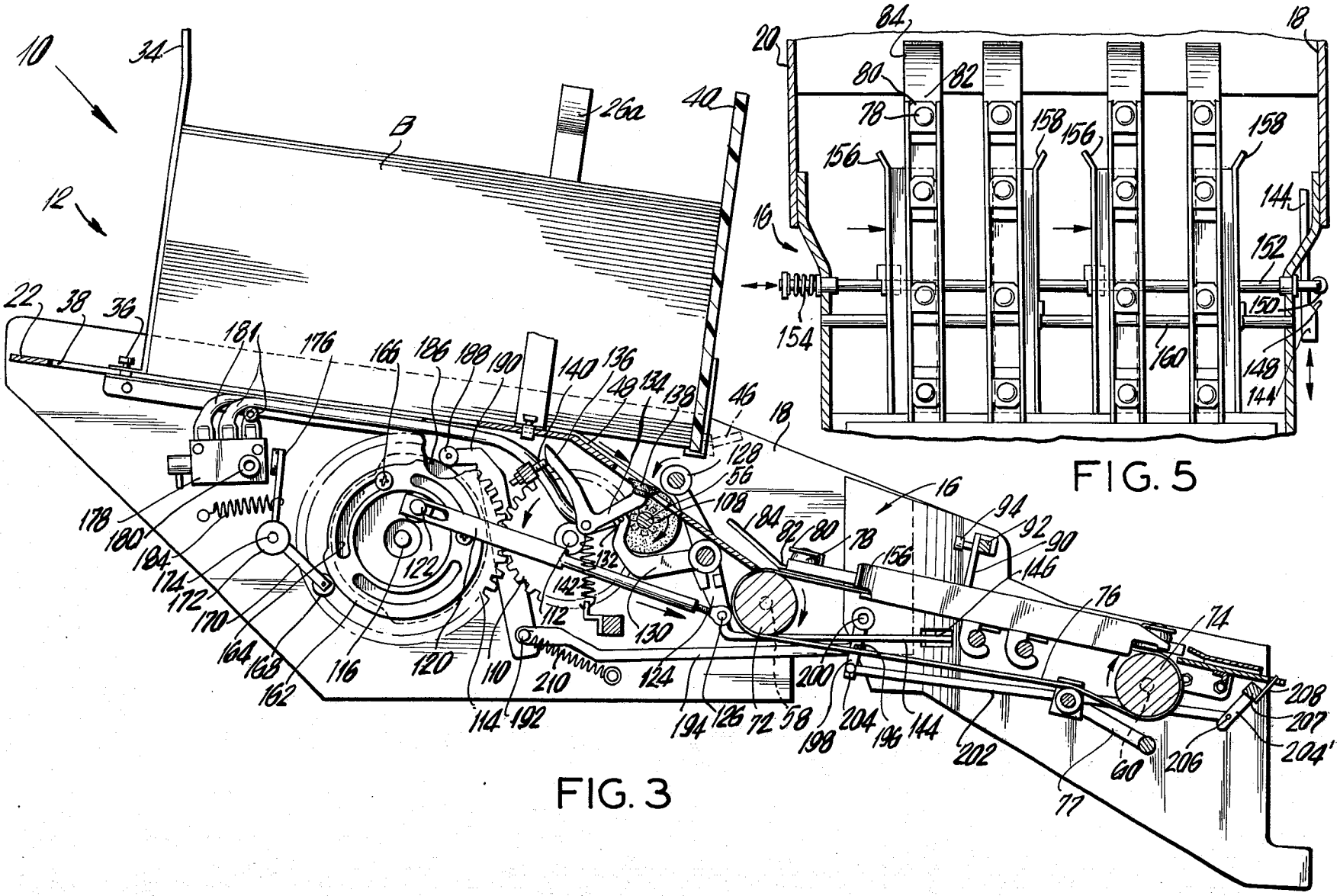
FIG. 3 is still another transverse sectional view taken along line 3—3 of FIG. 1.
FIG. 5 is a plan view, partially in section taken along line 5—5 of FIG. 1.

A rod 144 extends from the transverse pivot pin 126 through an opening 146 in the wall 16. The rod 144 is provided with a cam surface 148 that is adapted to be engaged by a cam follower 150 mounted on a transverse rod 152. A spring 154 biases the rod 152. As shown in FIG. 5, laterally adjustable guide plates 156 are rigidly secured to the transverse rod 152 and, alternating with the adjustable guide plates 156, are fixed guide plates 158 that are rigidly secured to a second transverse rod 160 which is mounted in the side walls 18 and 20. Each pair of the guide plates 156 and 158 straddle two of the belts 76 and the roller bearings 78 associated therewith.

Figure 4:
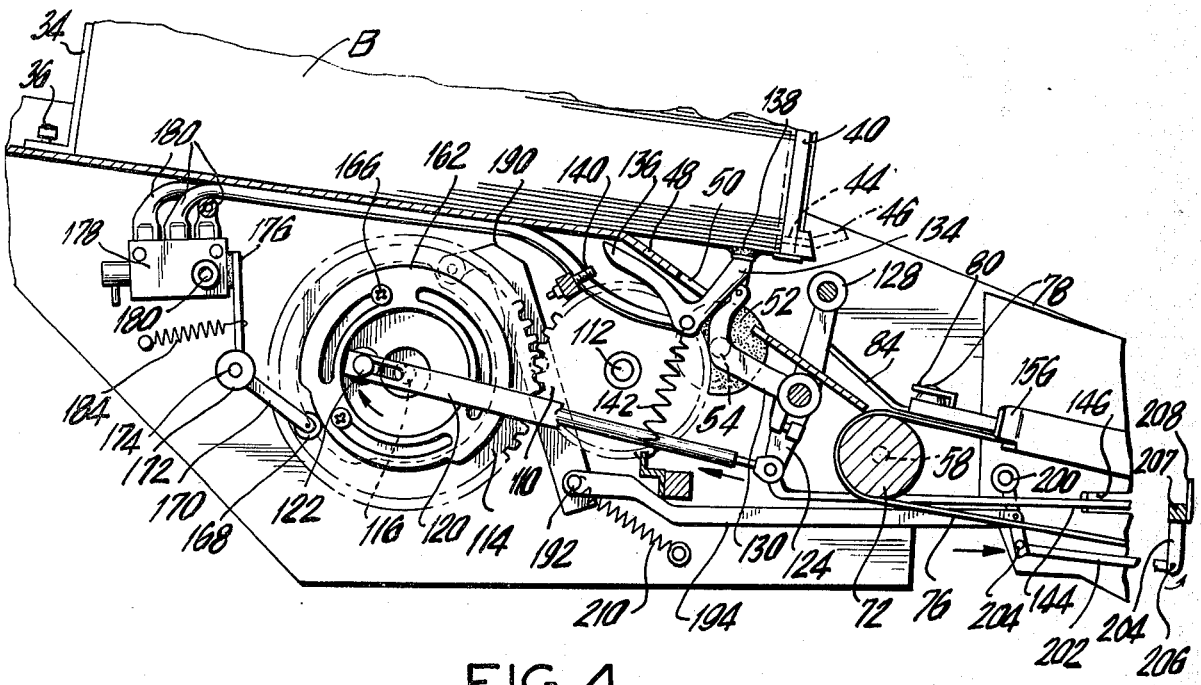
FIG. 4 is a transverse sectional view, similar to FIG. 3, but illustrating alternate positions of the components thereof.
Figure 2:
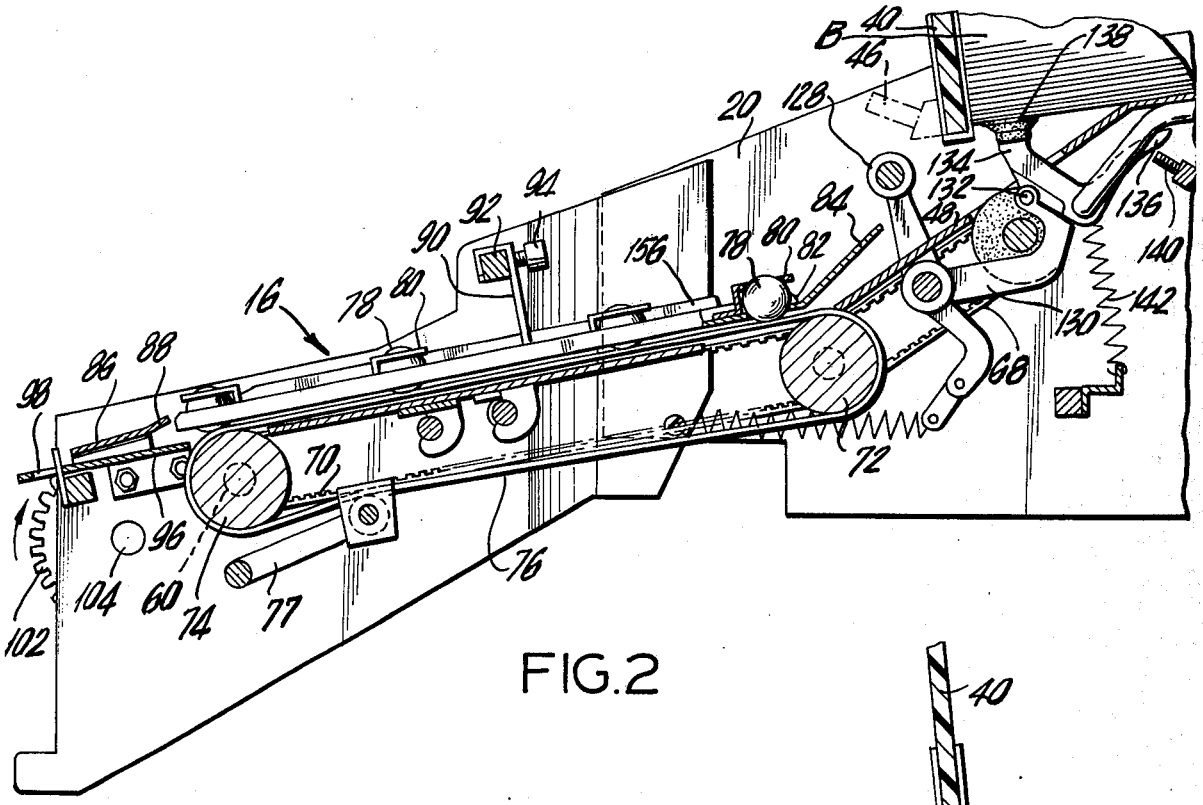
FIG. 2 is a transverse sectional view taken along line 2—2 of FIG. 1.
Figure 2A:
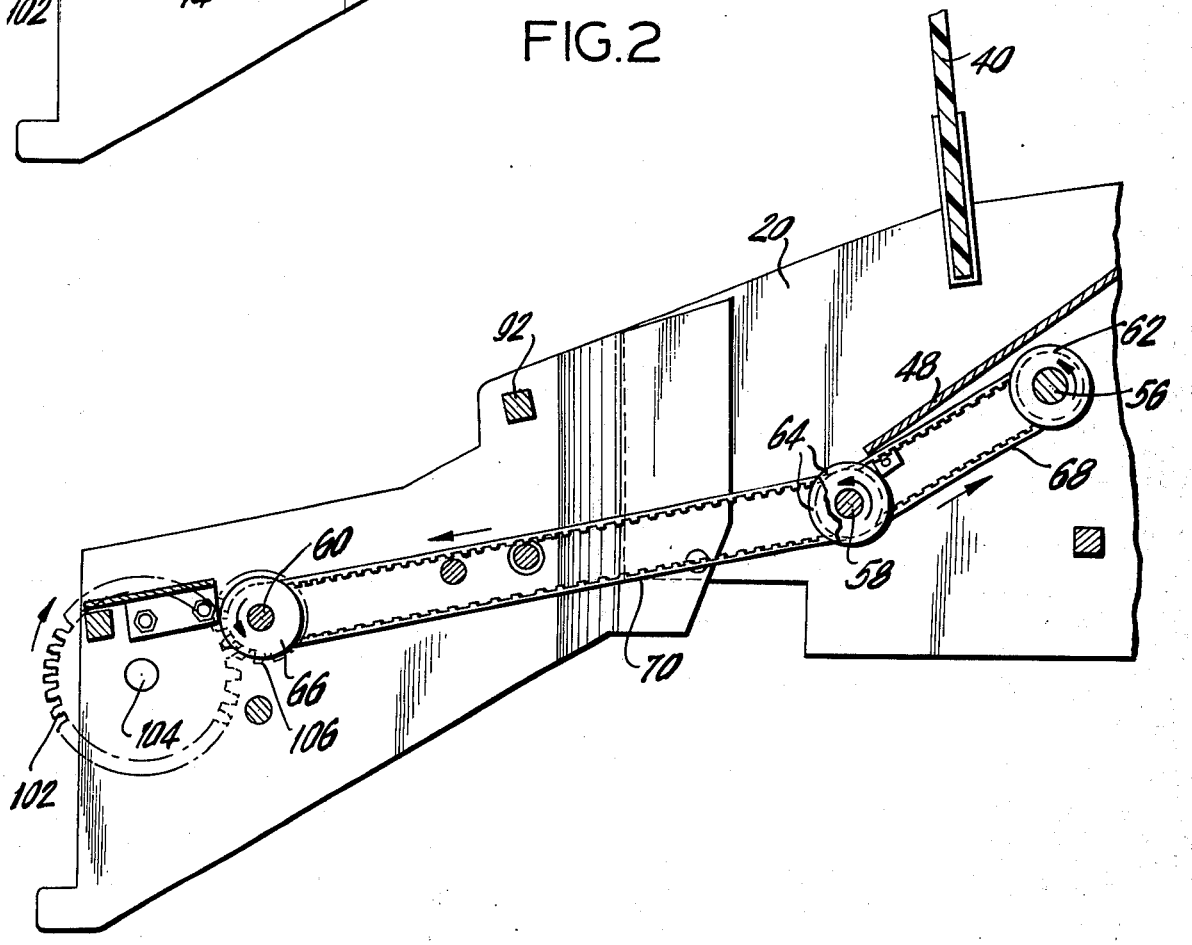
FIG. 2A is another transverse sectional view taken along line 2A—2A of FIG. 1.

A first cam 162 is mounted on the shaft 116 and is adjustably secured to the gear 114 by means of a plurality of arcuate slots 164 in the cam 162 and by means of screws 166. A cam follower 168 engages the cam 162 and is supported on an arm 170 that is integral with a hub 172 which is pivotally mounted, by means of a pin 174 to the wall 16. Another arm 176 is also mounted on the hub 172 and is arranged to open and close a valve 178 that is in communication with means for producing a vacuum (not shown). The inlet to the valve 178 is designated by the reference character 180. When the valve 178 is closed, for example as shown in FIG. 4, suction will be applied through a plurality of tubes 181 which are in communication at one end thereof with the valve 178. The opposite end of the tubes 181 are in communication with the suction cups 138. A spring 184 is used to bias the arm 176.

A second cam 186 is also mounted on the shaft 116 and is engaged by a cam follower 188 that is supported on an arm 190. A pivot pin 192 which is mounted in the wall 16 supports the other end of the arm 190. One end of a lever 194 is mounted on the pin 192 and the other end of the lever 194 is mounted on a pin 196 that pivotally supports an arm 198. A pin 200 pivotally secures one end of the arm 198 to the wall 16. The opposite end of the arm 198 supports one end of a link 202 by means of a pivot pin 204. The opposite end of the link 202 carries an arm 204 that is secured thereto by means of a pivot pin 206. The arm 204 is provided with a transverse bar 207 on which is mounted a plurality of fingers 208 that are adapted to extend through the openings 98 and are positioned downstream of the outlet plate 86. A spring 210 biases the pin 192.

Mode of Operation

When the feeder 10 is in the position shown in FIG. 1 the gear 102 will be in meshing engagement with one of the gears of the drive train of the printing device P. In this manner the gear 102, through the gear 106, will drive the timing belts 68 and 70 and will thereby drive the shaft 56. The gear 108, which is mounted on the shaft 56 will drive the gear 114 through the gear 110. Thus, it will be appreciated that the entire transmission system of the present invention is driven through the gear 102.

As the gear 114 rotates, the crank arm 120 will cause the levers 124 to oscillate about the pivot 126. The arms 134 that support the suction cups 138 will also be oscillated between the positions shown in FIGS. 3 and 4 by virtue of the connection 130 to the links 124. When the suction cups 138 are immediately adjacent and in contact with the lower most sheet in the stacks A and B, the rollers 128 will be positioned away from the rollers 52. When the suction cups 138 return to the position shown in FIG. 3, the rollers 128, in combination with the rollers 52, will pinch the pulled down sheet therebetween. Continued rotation of the rollers 52 will cause the pulled down sheet to move forwardly and downwardly onto the conveyor belts 76.

At the same time that the suction cups 138 are moving, cam 162 will cause the valve 178 to open and close. Suction is applied to the valve 178 and the tubes 181 when the arm 176 is in the valve closed position and the suction cups 138 are in their upper position as shown in FIG. 4. Continued rotation of the cam 162 will cause the arm 176 to open the valve 178 and thereby cut off the suction to the tubes 181 when the suction cups 138 are in their lowermost position shown in FIG. 3.

As mentioned hereinabove, the arm 144 is also coupled to the crank arm 120 and is caused to reciprocate when the gear 114 rotates. The cam surface 148 of the arm 144 will bear against the cam follower 150 and thereby laterally displace the shaft 152 in order to provide lateral movement to the two adjustable guide plates 156. This action causes positive alignment of the sheet against the fixed guides 158.

When the gear 114 rotates, the second cam 186 will also rotate and thereby pivot the arm 190 about the axis of the pin 192. The arms 194 and 202 will be reciprocated thereby to cause the fingers 208 to pivot about the pin 206 and thereby move upwardly and downwardly through the slot 50 in the plate 48. When the fingers 208 are in their uppermost position, they will temporarily block forward movement of the two sheets A and B along the conveyor belts 76 in order to assure perfect alignment and timed movement of the two sheets A and B. When the fingers 208 are retracted as shown in FIG. 3, the sheets A and B will continue into the printer apparatus P.

From the foregoing it will be appreciated that the transfer of the sheets through the several sections is controlled by a single transmission system that is coupled directly to the printing apparatus. Means are also provided for accurately positioning and aligning one or two sheets in the conveyor section. The cooperation of ball bearings and conveyor belts provides virtually friction-free transport of the sheets.

There has been disclosed heretofore the best embodiment of the invention presently contemplated. However, it is to be understood that various changes and modifications may be made thereto without departing from the spirit of the invention.

What I claim as new and desire to secure by Letters Patent is:

1. A top loading, sheet feeding attachment adapted to be coupled to and actuated by the drive means of a utilization device such as a multi-lith offset machine or the like that is capable of a first, normal mode of operation, said attachment being adapted to be left in place on the utilization device when said attachment is not being used without interfering with the first mode of operation of the utilization device, said attachment comprising, in combination:

a. a loading section for accepting at least one stack of the sheets to be fed to the utilization device;

b. a transfer section positioned downstream of and contiguously with said loading section, said transfer section including suction means for pulling downwardly the bottom sheet in the stack on said loading section and at least one pair of roller means for receiving the pulled-down sheet therebetween and for advancing the pulled-down sheet in a direction away from said suction means and away from said loading section;

c. conveyor means for receiving the pulled-down sheet from said roller means and for transporting the pulled-down sheet towards the utilization device;

d. aligning means for orienting the sheet on said conveyor means relative to the input of the utilization device, said aligning means including a first, longitudinally extending rail positioned parallel to one longitudinal edge of said belt and a second, laterally adjustable rail parallel to said first rail; and e. a transmission system including a drive train coupled to said conveyor means and adapted to be coupled to the drive means of the utilization device, said transmission system further comprising:

1. first actuating means for moving said suction means towards and into engagement with the bottom sheet in the stack and then in a direction away from the bottom of the stack and for moving at least one of said pair of roller means into and out of frictional driving engagement with the sheet therebetween;

2. first timing means for controlling the application of a vacuum to said suction means with respect to the movement of said first actuating means; and 3. second actuating means for operating said aligning means in timed relationship to the movement of said suction means and to the application of vacuum thereto, said second actuating means comprising a reciprocating crank arm driven by a portion of said transmission system, a cam driven by said crank arm in a direction substantially parallel to said second rail and a cam follower positioned so as to be engaged by said cam, said cam follower being secured to said second rail and limited to movement that is perpendicular to the length thereof.

2. The attachment according to claim 1 wherein said first actuating means comprises a reciprocating crank arm driven by said transmission system and linkage means for pivotally supporting said suction means, said linkage means being coupled to said crank arm.

3. The attachment according to claim 2 wherein said first timing means comprises a cam coupled to and driven by said transmission system, a cam follower responsive to the movement of said cam, valve means in fluid communication with said suction means and a source of vacuum and means for selectively opening and closing said valve means, said means for selectively opening and closing said valve means being coupled to said cam follower means.

4. The attachment according to claim 1 wherein said loading section includes, means for locating two separate stacks of the sheets to be fed to the utilization device and wherein there is further included displaceable barrier means positioned proximate the downstream end of said conveyor means for temporarily arresting the longitudinal movement of the sheets on said conveyor means and second timing means for controlling the movement of said barrier means with respect to the movement of the sheets along said conveyor means.

5. The attachment according to claim 4 wherein said second timing means comprises a cam driven by said transmission system and a cam follower responsive to said cam, said barrier means comprising linkage means coupled to and driven by said cam follower and finger means secured to said linkage means whereby as said cam means is driven said finger means will be moved into and out of the path of the sheets on said conveyor means to thereby align the leading edges of the sheets prior to their entry into the utilization device.

6. The attachment according to claim 4 wherein said locating means includes means for accurately positioning at least the longitudinal edges of both stacks of sheets.

7. The attachment according to claim 6 wherein said positioning means are laterally adjustable.

8. The attachment according to claim 4 wherein there is further included means for accurately positioning the rearward transverse edges of both stacks of sheets.

9. The attachment according to claim 8 wherein said means for positioning the transverse edges of both stacks of sheets are adjustable.

10. The attachment according to claim 9 wherein said means for positioning the longitudinal edges of both stacks of sheets are adjustable.

11. The attachment according to claim 1 wherein said transmission system further includes a timing belt for coupling said conveyor means to one of said rollers in said pair of rollers in said transfer section.

* * * * *